US005531446A

United States Patent [19]

Scheie et al.

[11] Patent Number: 5,531,446

[45] Date of Patent: Jul. 2, 1996

[54] GOLFER'S PUTTING AID

[75] Inventors: Carl E. Scheie, Libertyville, Ill.; Paul Guy, Omaha, Nebr.

[73] Assignee: Wilson Sporting Goods Co., Chicago, Ill.

[21] Appl. No.: 373,553

[22] Filed: Jan. 17, 1995

[51] Int. Cl.[6] ..... A63B 69/36

[52] U.S. Cl. ..... 473/227

[58] Field of Search ..... 273/187.2, 187.4, 273/187.5, 186.2, 188 R, 191 R, 192, 193 R, 194 R, 81.2, 81.3, 81.4, 81 B, 81 D, 81 R, 35 R, 183.1, 194 A, 193 A, 162 R, 163 A, 164.1, 164.2

[56] References Cited

U.S. PATENT DOCUMENTS

| | | | |
|---|---|---|---|
| 1,561,349 | 11/1925 | Murphy et al. | 273/81.3 |
| 2,092,839 | 9/1937 | Gouverneur | 273/81.4 |
| 2,706,635 | 4/1955 | Thomas | 273/192 |
| 2,801,106 | 7/1957 | Koehler | 273/81.3 |
| 3,188,086 | 6/1965 | Parmley | 273/81.3 |
| 4,023,812 | 5/1977 | Lorang | 273/186 A |
| 4,399,994 | 8/1983 | Hourihan | 273/191 R |
| 4,804,181 | 2/1989 | Foster | 273/81 D |
| 4,880,240 | 11/1989 | Lewis | 273/183 R |
| 5,026,066 | 6/1991 | Kane | 273/192 |
| 5,058,891 | 10/1991 | Takeuchi | 273/81 B |
| 5,125,657 | 6/1992 | Beil | 273/77 R |
| 5,156,401 | 10/1992 | Hodgkiss | 273/186.2 |
| 5,203,567 | 4/1993 | Erlinger et al. | 273/187.2 |
| 5,248,146 | 9/1993 | Viets et al. | 273/189 R |
| 5,308,071 | 5/1994 | Lewis | 273/187.2 |

OTHER PUBLICATIONS

Handbook Of Chemistry And Physics, Charles D. Hodgman, M.S. 1936 Published By Chemical Rubber Publishing Co. Cleveland Ohio p. 1217.

*Primary Examiner*—William H. Grieb

[57] ABSTRACT

A putting aid for a golf putter comprises an elongated rod and a generally spherical end member mounted on the rod. The rod is adapted to be slidably inserted through an opening in the end of the grip of the putter. The distance of the end member from the grip is adjusted so that the end member contacts the body of a golfer when he assumes his putting stance. The portion of the end member which contacts a golfer's body has relatively low friction so that the end member moves relative to the body if the proper putting stroke is not used.

7 Claims, 1 Drawing Sheet

17
19
21
18
15
14
13
10
12
11

19
20
18
17
13
12

19
18
13
G
12
11
B

G
19
18
12
11
B

G
19
18
13
12
11

G
19
18
13
12
11

GOLFER'S PUTTING AID

BACKGROUND

This invention relates to golf putting aids, and, more particularly, to a putting aid which promotes a pendulum putting stroke.

A putting aid is a device which is used during practice to promote a desired putting stroke. Putting aids are usually not a permanent part of the putter and are usually not allowed during competition.

A pendulum-like putting stroke, in which the arms act together as a unit while wrist involvement is minimized, has been found to be very effective. Although several training aids have been developed with the intent of producing such a stroke, these aids are limited in their effectiveness for several reasons. Any device which physically restricts the golfer's motion may create a dependency upon that restriction, and as a result, the golfer may not be able to perform the correct stroke without the presence of the training aid. Currently available devices have also shown a lack of adaptability, a significant drawback considering the wide variety of putters and putting styles in use by golfers.

SUMMARY OF THE INVENTION

The invention provides a putting aid which promotes a pendulum putting stroke. The putting aid can be used with substantially all putters and can be used with the golfer's normal stance, grip, and set-up. The putting aid comprises an elongated rod and an end member, preferably spherical, mounted on one end of the rod. The rod is slidably inserted through the opening which is conventionally provided in the butt cap or top end of the grip of a putter. The diameter of the rod is greater than the diameter of the opening, and the rod is frictionally retained by the grip. The distance of the end member from the grip is adjusted so that the end member contacts the body of the golfer when he assumes his putting stance. If the golfer correctly executes a pendulum stroke, the end member remains in contact with the body. If the golfer breaks his wrists or otherwise does not execute a pendulum stroke, the end member moves out of contact with the body and indicates an error.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
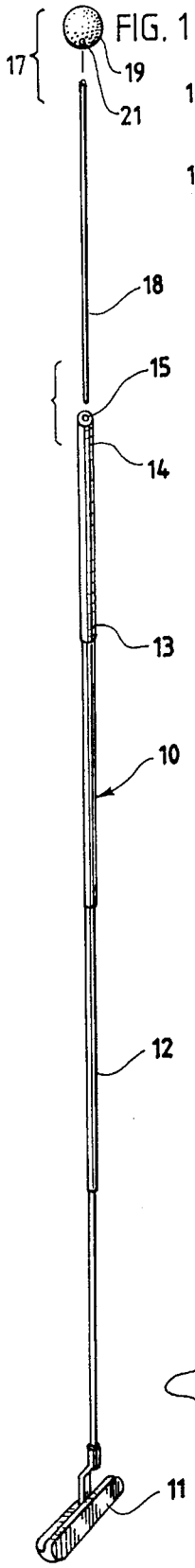
FIG. 1 is an exploded perspective view of a putting aid in accordance with the invention and a putter.
Figure 2:
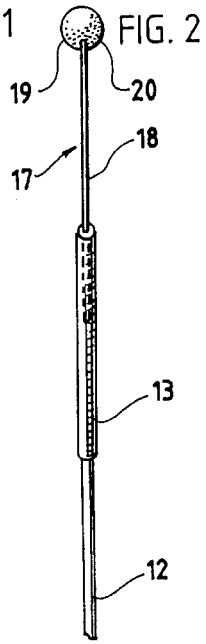
FIG. 2 is a fragmentary perspective view illustrating the putting aid inserted into the grip of the putter.

Referring first to FIGS. 1 and 2, a conventional golf putter 10 includes a putter head 11, a shaft 12, and a grip 13 on the upper end of the shaft. The grip includes a butt end or cap 14 which covers the upper end of the shaft. The butt end of the grip is provided with an opening 15 which is conventional in most putter grips.

A putting aid designated generally by the numeral 17 includes an elongated rod 18 and an end member 19. In the specific embodiment illustrated, the end member 19 is spherical and is provided with dimples 20 in its outer surface to simulate a golf ball. It is not necessary that the end member be completely spherical, but it is preferable that the upper portion of the end member which contacts a golfer's body during use be substantially spherical.

The portion of the end member which contacts the golfer's body should also be formed from material which has relatively low friction so that the end member will move relative to the golfer's body if the desired pendulum putting stroke is not executed. The surface of the end member which contacts the golfer's body is preferably formed from polymeric material or plastic such as polyurethane or ionomer resins such as Surlyn ionomer from E.I. DuPont de Nemours & Co.

In one specific embodiment, the rod 18 had a diameter of about 3/16 inch or 0.1875 inch, and the spherical end member 19 had a radius of about 0.84 inch, which is the radius of a conventional golf ball. If only the golfer-contacting portion of the end member is spherical, the radius of that portion is preferably about 0.84 inch. One end of the rod 18 is inserted into an opening 21 in the end member 19 and is preferably permanently attached by adhesive.

The opening 15 in the grip of most putters has a diameter of about 0.12 inch. The diameter of the rod 18 is selected so that the rod can be inserted into the opening 15 and be frictionally engaged by the periphery of the opening and thereby retained in a selected position. The diameter of the rod can be within the range of about 0.125 to 0.200 inch. The material of most grips is rubber or other elastomeric material which is resiliently deformable to allow the rod to be inserted into the opening 15. The rod extends axially with respect to the grip 13 and the shaft 12.

A golfer who uses the putting aid pushes or pulls the rod 18 relative to the opening 15 in the grip until the distance from the end member 19 from the butt end of the grip is such that the end member will contact the golfer's body when the golfer assumes his normal grip, stance, and set-up. The end member will contact a different portion of the body of different golfers, and a golfer need not worry about holding the putter in a particular manner. The putting aid is adaptable to any style of grip, address, and set-up. The only requirement is that the end member contact the body when the golfer addresses a golf ball.

Figure 3:
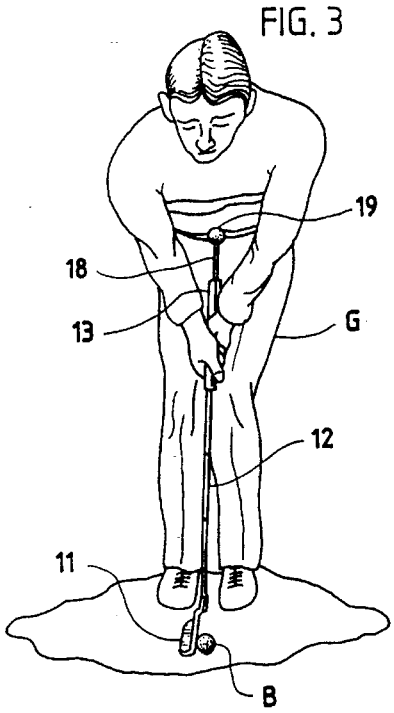
FIG. 3 illustrates a golfer addressing a golf ball with the putter and putting aid.

FIG. 3 illustrates a golfer G addressing a golf ball B. The golfer uses his normal grip, stance, and set-up relative to the ball and the intended line of putt. The rod 18 is adjusted relative to the grip 13 so that the end member 19 contacts the golfer's body, in this case, the abdomen. To be precise, the end member contacts the outer garment worn by the golfer, but it will be understood that the word "body" includes garments worn by the body. The end member need not contact the body with any particular force. It is sufficient if an improper putting stroke will cause relative movement between the end member and the body.

Figure 4:
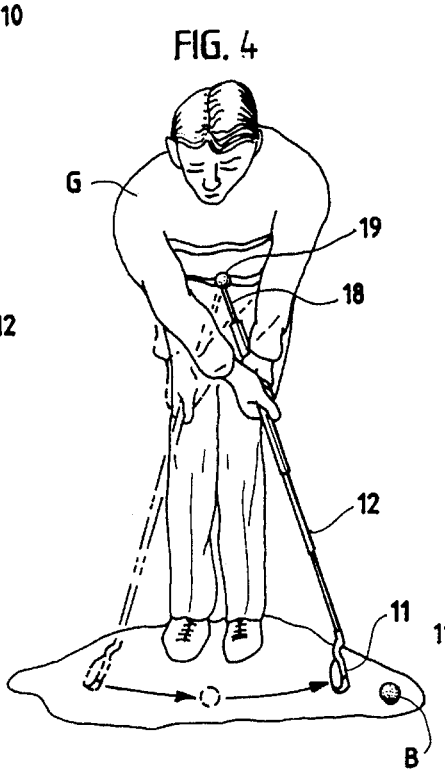
FIG. 4 illustrates the golfer executing a putting stroke.

FIG. 4 illustrates a golfer making a proper pendulum stroke. The putter is moved by the arms of the golfer without breaking his wrists. The pivot point of the pendulum stroke is the end member 19, and the end member does not move relative to the golfer's body and remains in contact with the body during the stroke.

If the golfer hinges or breaks his wrists during the stroke, the pivot point of the stroke will not be the end member, and the end member will move out of contact with the golfer's body. The golfer will therefore be alerted to the fact that he made an improper stroke. Any other error in the stroke which causes the putter to deviate from a true pendulum stroke which pivots at the end member will also cause the end member to move relative to the body and will indicate an error in the stroke.

It is important that the portion of the end member which contacts the body have a relatively low coefficient of friction so that the end member is free to move relative to the body and perform its error-indicating function. The purpose of the putting aid is not to restrain the golfer into making a stroke in a particular manner but to inform the golfer when the stroke is not made properly. Since the putting aid cannot be used in competition, the object of the putting aid is to teach the golfer the feel of a correct stroke without physically restraining his grip or stroke and thereby forcing the golfer to assume a particular grip or stroke.

In one specific embodiment, the portion of the end member which contacts the golfer's body had a coefficient of friction of about 0.5. The coefficient of friction is preferably within the range of about 0.2 to 1.0. Even if the surface of the end member is dimpled to simulate the appearance of a golf ball, the dimples do not adversely affect the desired low-friction surface. The surface of the dimpled end member is still relatively smooth with respect to providing a low-friction surface for engaging the body.

The putting aid is adaptable to any style of putting, address, or set-up. The distance of the end member 19 from the butt end of the grip 13 is easily adjusted simply by pushing the rod into the grip or pulling the rod out of the grip. When the desired position is attained, the friction between the grip and the rod retains the rod in the desired position.

Figure 5:
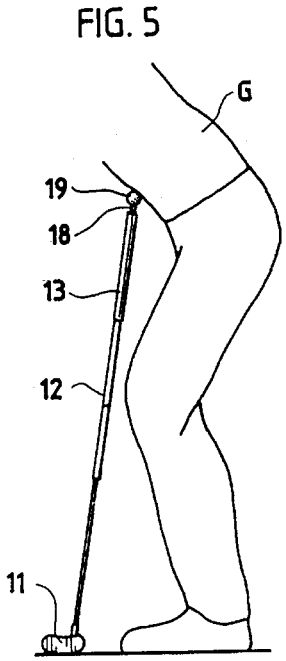
FIG. 5 illustrates the position of the putting aid relative to the putter for one particular golfer.
Figure 6:
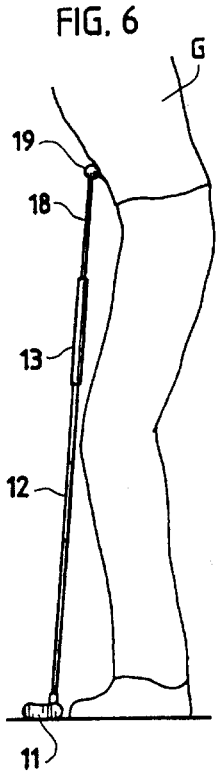
FIG. 6 illustrates the position of the putting aid relative to the putter for another golfer.

FIG. 5 illustrates a golfer who uses a relatively crouched putting stance. The rod 18 is pushed into the grip 13, and the end member 19 is positioned very close to the grip 13. The end member contacts the golfer's body close to his waist. FIG. 6 illustrates a golfer who uses an upright putting stance. The rod is extended from the grip 13, and the end member is spaced farther from the grip. The end member contacts the golfer's body in his abdomen above his waist.

As illustrated in FIG. 3, the putting aid does not force the golfer to grip the putter in a certain way. The golfer can extend his arms and keep his wrists substantially unbroken, hold his hands close to his body with his wrists broken, etc. Some putting aids force the golfer to grip the putter in a way which might not be natural to the golfer. When that type of putting aid is removed, the golfer has a tendency to resume his normal grip.

Instead of restraining a golfer's grip or stroke, the inventive putting aid teaches the golfer the feel of the correct stroke without restraining his grip or stroke. The golfer knows he made a proper stroke if the end member remains in contact with his body. The golfer knows he made an improper stroke if the end member does not remain in contact with his body.

After the golfer has completed his practice with the putting aid, the putting aid can be removed from the putter, and the putter can be used in competition.

While in the foregoing specification a detailed description of specific embodiments of the invention were set forth for the purpose of illustration, it will be understood that many of the details herein given can be varied considerably by those skilled in the art without departing from the spirit and scope of the invention.

We claim:

1. In combination, a golf putter and a putting aid, the golf putter including a putter head, a shaft, and a grip on the upper end of the shaft, the grip being formed of elastomeric material and having a butt end with an opening therein, the putting aid comprising an elongated rod slidably inserted through the opening in the butt end of the grip and an end member attached to the rod, the diameter of the rod being greater than the diameter of the opening in the butt end of the grip so that the elastomeric material of the butt end is resiliently deformed by the rod and the rod is frictionally retained in the opening whereby the distance of the end member from the butt end can be adjusted by sliding the rod within the opening, the end member having a generally spherical surface portion adapted to be pressed against a body of a golfer whereby the end member will move relative to the body of a golfer if the correct putting stroke is not used.

2. The putting aid of claim 1 in which the generally spherical surface portion is provided with dimples which simulate the outer surface of a golf ball.

3. The putting aid of claim 1 in which the radius of the generally spherical surface portion is about 0.84 inch.

4. The putting aid of claim 1 in which the diameter of the rod is about 3/16 inch.

5. The putting aid of claim 1 in which the end member is generally spherical.

6. The method of practicing a putting stroke with a putter having a putter head, a shaft, and a grip on the upper end of the shaft, the grip being formed of elastomeric material and having a butt end with an opening therein comprising the steps of:

mounting an end member on an elongated rod, the rod having a diameter greater than the diameter of the opening in the butt end of the grip, inserting the rod through the opening in the butt end of the grip so that the rod deforms the elastomeric material of the butt end and is frictionally retained in the opening in the butt end and extends axially with respect to the grip, adjusting the distance of the end member from the butt end of the grip by sliding the rod in the opening in the butt end so that the end member will contact the body of a golfer when the golfer assumes his putting stance, and swinging the putter so that the end member remains in contact with the golfer's body during the swing.

7. The method of claim 6 including the step of completely withdrawing the rod from the opening in the butt end of the grip and using the putter without the rod and the end member.

* * * * *